US011512708B1

(12) United States Patent
Chen et al.

(10) Patent No.: US 11,512,708 B1
(45) Date of Patent: Nov. 29, 2022

(54) VISCOUS FLOW FAN IMPELLERS HAVING WAVE BLADES

(71) Applicant: HEWLETT-PACKARD DEVELOPMENT COMPANY, L.P., Spring, TX (US)

(72) Inventors: Shih-Han Chen, Taipei (TW); Chien-tu Cheng, Taipei (TW); Jen-Hsun Hsieh, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/364,416

(22) Filed: Jun. 30, 2021

(51) Int. Cl.
*F04D 29/28* (2006.01)
*F04D 29/66* (2006.01)
*F04D 17/16* (2006.01)

(52) U.S. Cl.
CPC ..... *F04D 29/281* (2013.01); *F04D 17/16* (2013.01); *F04D 29/666* (2013.01)

(58) Field of Classification Search
CPC ..... F04D 29/281; F04D 17/16; F04D 29/666
See application file for complete search history.

(56) References Cited

U.S. PATENT DOCUMENTS

2019/0274482 A1* 9/2019 Abdo ..... A47J 43/0465

FOREIGN PATENT DOCUMENTS

| | | | | |
|---|---|---|---|---|
| AU | 2015218543 A1 * | 9/2015 | ..... | A01K 63/04 |
| CN | 109996479 A * | 7/2019 | ..... | A47J 43/0465 |
| CN | 111315268 A * | 6/2020 | ..... | A47J 27/004 |
| CN | 112628199 A * | 4/2021 | ..... | F04D 29/281 |
| CN | 112727793 A * | 4/2021 | | |

* cited by examiner

*Primary Examiner* — Michael Lebentritt
(74) *Attorney, Agent, or Firm* — Dicke Billig & Czaja PLLC

(57) ABSTRACT

An impeller for a viscous flow fan includes a hub having a longitudinal axis, and a plurality of ring-shaped wave blades disposed about and coupled to a perimeter of the hub, the wave blades disposed in a parallel and spaced apart from one another along the longitudinal axis by a blade gap. Each wave blade includes a center coincident with the longitudinal axis, an inner perimeter, an outer perimeter, and a wave-like cross-section about the perimeter of the hub in a direction perpendicular to the longitudinal axis, wherein at least a portion of the inner perimeter of at least one of the wave blades is spaced from the perimeter of the hub to form an air intake gap.

15 Claims, 7 Drawing Sheets

VISCOUS FLOW FAN IMPELLERS HAVING WAVE BLADES

BACKGROUND

Blower fans are employed to provide air flows for a variety of purposes, including for cooling of electronic components (e.g., semiconductor chips, power supplies, etc.) in any number of devices (e.g., laptops, PCs, servers, etc.). Commonly, blower fans are centrifugal fans which employ a turbine-like impeller having a number of blades radially disposed about a hub. While effective at generating air flows, centrifugal blower fans may generate uncomfortable levels of high frequency noise.

DETAILED DESCRIPTION

Figure 1A:
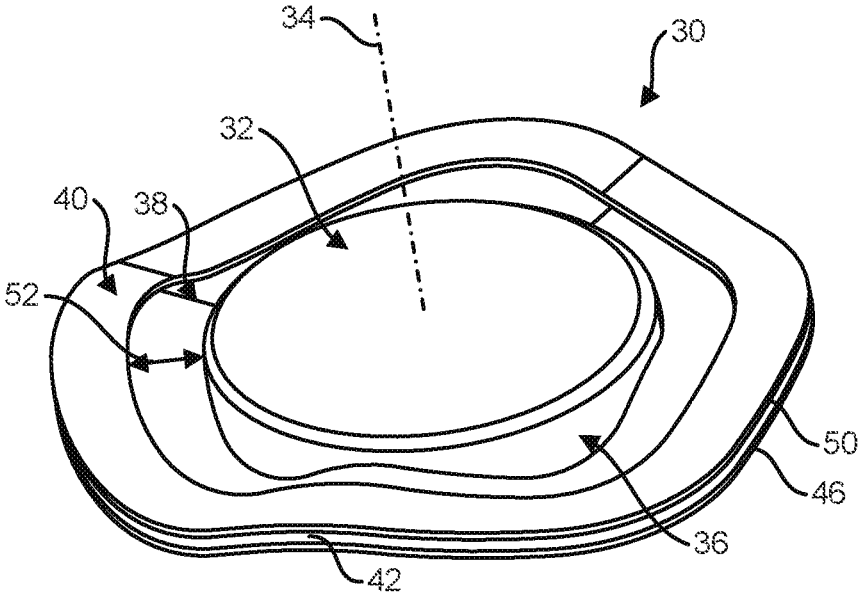
FIG. 1A a perspective view of a viscous flow impeller for a viscous flow blower fan, according to one example.
Figure 1B:
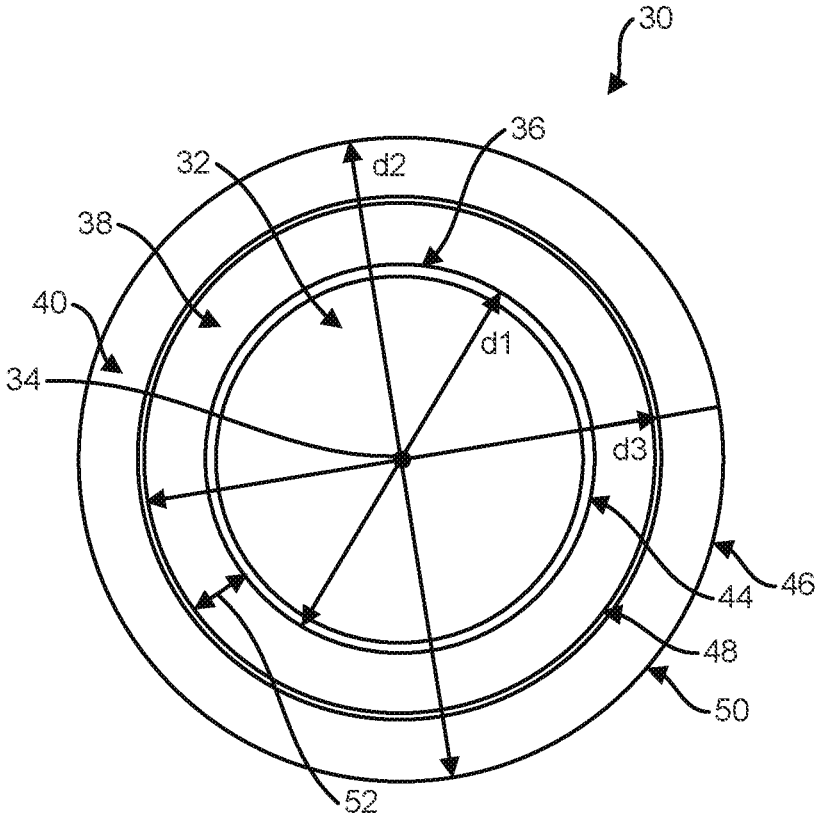
FIG. 1B is a top view of a viscous flow impeller for a viscous flow blower fan, according to one example.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Blower fans are employed to provide air flows for a variety of purposes, including for cooling of electronic components (e.g., semiconductor chips, power supplies, etc.) in any number of devices (e.g., laptops, PCs, servers, etc.). Commonly, blower fans are centrifugal fans which employ a turbine-like impeller having a number of blades radially disposed about a hub. The impeller is disposed within a housing, wherein the housing defines an air intake and a duct, also referred to as a flow tunnel, extending about a portion of a circumference of the impeller blades, with the flow tunnel typically increasing in size (e.g., area) from a narrower inlet throat to a wider outlet. When the hub is driven about a rotational axis (e.g., a longitudinal axis of the hub), the blades enter the flow tunnel at the inlet throat and exit at the outlet with major surfaces of the blades being disposed perpendicular to the direction of rotation. As the impeller rotates, air is drawn through the air intake (typically in a direction parallel with the rotational axis), friction between the air and blades together with a centrifugal force creates and accelerates an intake air flow across the major surfaces of the blade and into the flow tunnel. An output air flow from the outlet of the flow tunnel is directed to cool a component, such as across a heat sink, for example.

While centrifugal type blower fans are effective at generating air flows, air pressure created by the tips of the blades passing into the narrow inlet throat of the flow tunnel generates uncomfortable levels of high frequency noise, sometimes referred to as a "blade passing tone." In attempts to reduce the level of blade passing tone, some centrifugal type blower fans employ impellers with reduced diameters in order to increase the size of the inlet throat (i.e., decrease air pressure by increasing the spacing between the blade tips and the wall of the flow tunnel), or modify the air intake design to modify air pressure in the flow tunnel (e.g., by covering the air intake proximate to the inlet throat). While such modifications may somewhat reduce blade passing tone, they also reduce fan performance.

Another type of blower fan is referred to as a viscous flow blower fan. Known viscous flow blower fans include an impeller having a number of flat, disk-shaped blades disposed about a circumference of a central hub, wherein the blades are disposed in parallel and spaced apart from one another along a longitudinal axis of the central hub. Due to a viscosity of the air, when the blades are driven about a rotational axis (e.g., a longitudinal axis of the central hub), a shearing force between adjacent disk-like blades draws air from the intake and creates a viscous air flow between the disks which is accelerated and directed into the surrounding flow tunnel by a centrifugal force of the rotating blades to create an output air flow at the outlet of the flow tunnel. Because the major surfaces of the disk-like blades are parallel to the direction of rotation (with only a thickness of the disk-likes blades being perpendicular to the direction of rotation), viscous blower fans greatly reduce the "passing tone" relative to centrifugal fans. However, blade stacks comprising many disk-like blades (e.g., 3, 4, or more blades) are needed to achieve air flows comparable to centrifugal blower fans, which increases dimensions of the viscous blower fan (e.g., in a direction of the rotational axis).

In accordance with the present disclosure, a viscous flow blower fan is described which employs an impeller with disk-shaped fan blades having a wave-like cross-section (e.g., sinusoid-like) about a perimeter of the central hub rather than a flat cross-section as employed by known viscous flow blower fans. In examples, at least two so-called "wave blades" a spaced apart from one another by a gap distance along a rotational axis of the axis. In one example, such gap distance may be less than 5 millimeters. In other examples, more than two wave blades may be spaced apart from one another along the rotational axis of the hub (e.g., 3 wave blades, 4 wave blades, etc.).

Employing a wave-like cross-section, in accordance with teachings of the present disclosure, increases a surface area of the disk-like fan blades, which increases a shear force between adjacent blades and increases the viscous air flow generated there between. In addition to eliminating blade passing tone relative to conventional centrifugal fans, a viscous flow fan employing wave blades, in accordance with the present disclosure, provides increased air flow within a same or smaller footprint than conventional viscous blower fans while employing fewer parts, thereby improving performance and reducing costs relative to conventional viscous blower fans.

FIGS. 1A-1D respectively illustrate a perspective view, a top view, a side view, and a perspective cross-sectional view of a viscous flow impeller 30 for a viscous flow blower fan, according to one example of the present disclosure. As described in greater detail below, viscous flow impeller 30 of FIGS. 1A-1D is implemented for use with a single inlet viscous blower fan (e.g., see FIGS. 2A-4). Impeller 30, according to one example, includes a cylindrical hub 32 having a longitudinal axis 34 defining a rotational axis of impeller 30 (such that longitudinal axis 34 may also sometimes be referred to as rotational axis 34), and a diameter, d1, defining an outer perimeter 36 of hub 32. A first wave-shaped circular disk blade 38, and a second wave-shaped circular disk blade 40 are disposed in a ring-like fashion about outer perimeter 36 of hub 32, with first and second blades 38 and 40 being disposed in parallel and spaced apart from one another along longitudinal axis 34 by a blade gap 42. Hereinafter, first and second wave-shaped circular disk blades 38 and 40 are referred to as first wave blade 38 and second wave blade 40.

First and second wave blades 38 and 40 each have a center coincident with longitudinal axis 34. In one example, first wave blade 38 has an inner diameter, d1, the same as the diameter of hub 32, and an outer diameter, d2, so as to define an inner perimeter 44 and an outer perimeter 46, with inner perimeter 44 being coupled to outer perimeter 36 of hub 32 so as to be contiguous therewith. In one example, hub 32 and first wave blade 38 may be molded as a single piece. In one examples, second wave blade 40 has an inner diameter, d3, and an outer diameter, d2, the same as the outer diameter of first wave blade 38, so as to define an inner perimeter 48 and an outer perimeter 50, where inner diameter, d3, of second wave blade 40 is greater than hub diameter, d1, such that inner perimeter 48 of second wave blade 40 is spaced from outer perimeter 36 of hub 32 to form an air intake gap 52 there between. As described in greater detail below, air intake gap 52 provides an air flow path for intake air to be received into blade gap 42 between first and second wave blades 38 and 40 when implemented in a single inlet viscous air flow fan (e.g., see at least FIGS. 2A & 3 below).

Figure 1C:
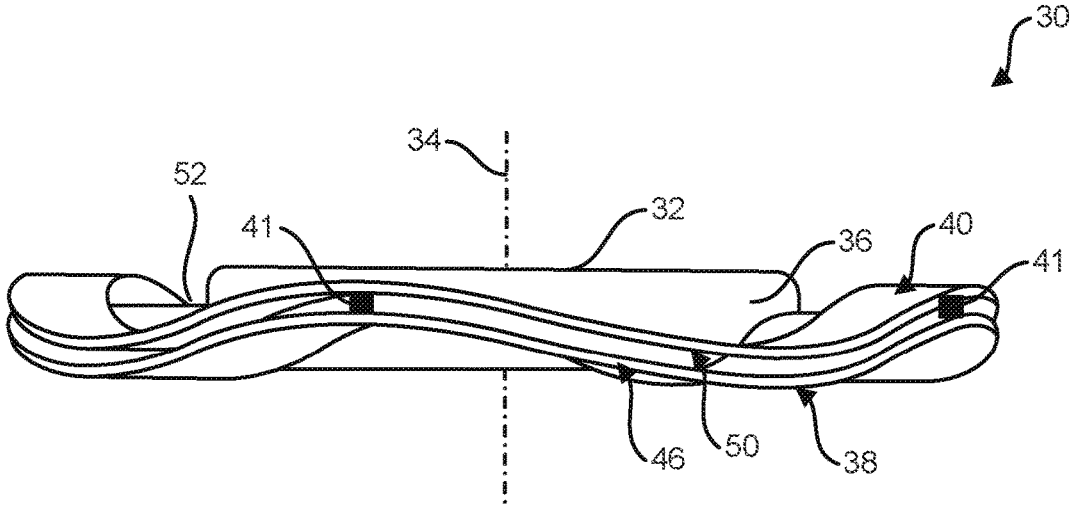
FIG. 1C, a side view of a viscous flow impeller for a viscous flow blower fan, according to one example.
Figure 1D:
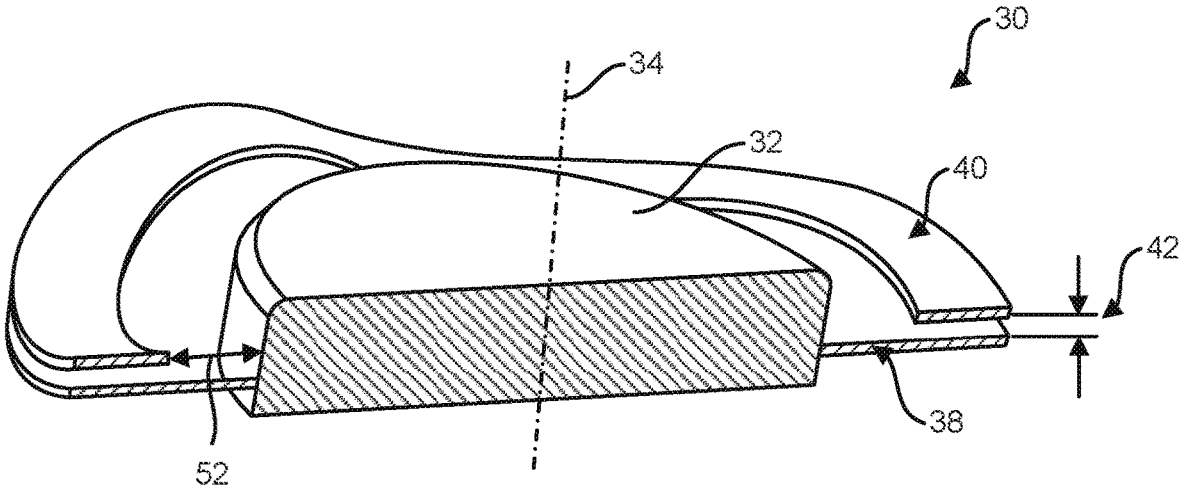
FIG. 1D a perspective cross-sectional view of a viscous flow impeller for a viscous flow blower fan, according to one example.

With particular reference to FIG. 1C, while first and second wave blades 38 and 40 are circular when viewed along rotational axis 34, first and second wave blades 38 and 40 each have a wave-like cross-sectional profile about the perimeter of hub 32 when viewed in a direction perpendicular to rotational axis 34. In one example, first and second wave blades 38 and 40 may each have a sinusoidal cross-sectional profile about the perimeter of hub 32, where a period and/or an amplitude of the cross-sectional profile varies at different diameters of first and second wave blades 38 and 40. In examples, first and second wave blades 38 and 40 each have a same wave-live profile so as to be in parallel with one another.

In one example, second wave blade 40 is supported from first wave blade by a plurality of support posts, such as illustrated by support post 41, distributed about a diameter of first and second wave blades 38 and 40, where support posts 41 additionally serve to define blade gap 42. In examples, the wave-like shape of first and second wave blades 38 and 40, as well as support posts 41, are even distributed about the circumference of hub 32 such that that a mass of impeller 30 is rotationally balanced about rotational axis 34 to eliminate rotational wobble.

As described in greater detail below, relative to conventional flat circular disk blades, the wave-like cross-sectional profile of first and second wave blades 38 and 40 increases the surface areas of the facing the major surfaces of first and second wave blades 38 and 40. The increase in surface area increases a shearing force in blade gap 42 between first and second wave blades 38 and 40, which, together with a centrifugal force from rotation of impeller 30 about rotational axis 34, increases a viscous air flow generated in blade gap 42 between first and second wave blades 38 and 40 relative to conventional flat circular disk blades.

Figure 2A:
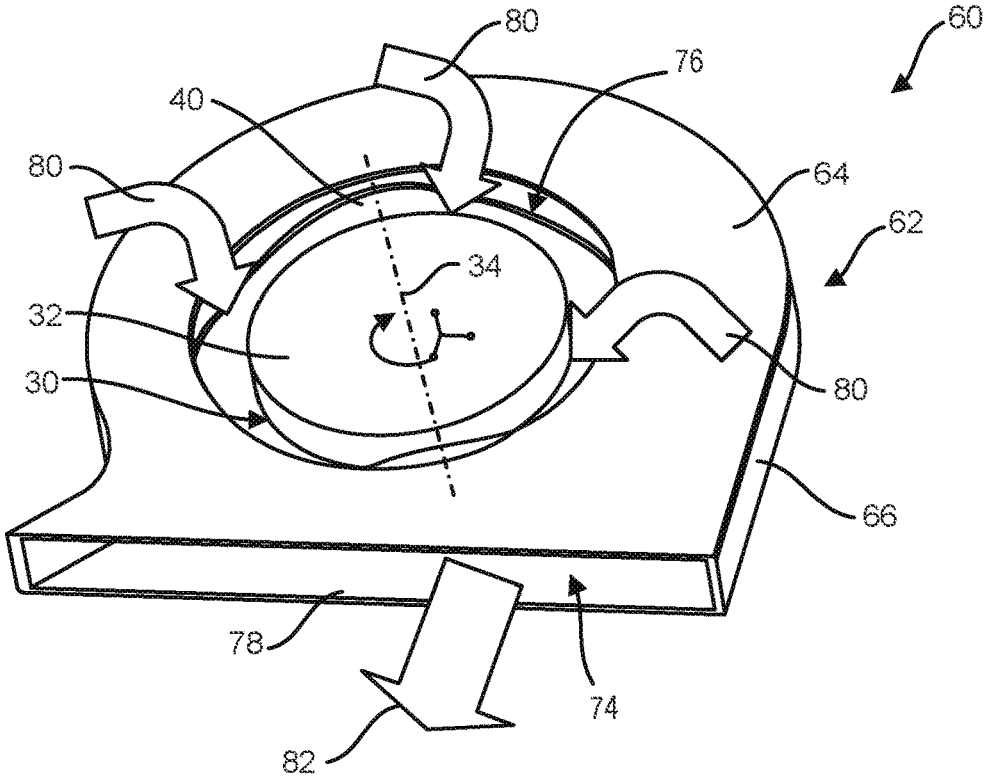
FIG. 2A is a perspective view of a viscous flow blower fan, according to one example.
Figure 2B:
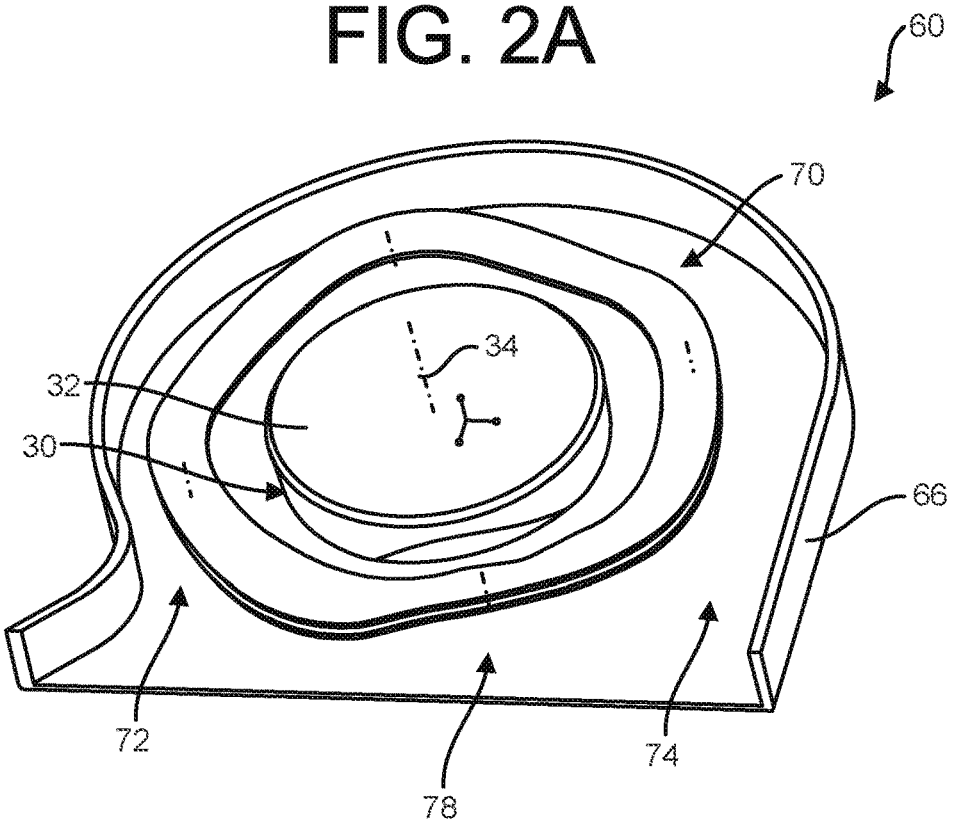
FIG. 2B is a perspective view of a viscous flow blower fan with a top cover removed, according to one example.

FIGS. 2A-2C illustrate a single inlet viscous blower fan 60 employing an impeller 30, in accordance with the present disclosure, with FIG. 2A illustrating a perspective view, FIG. 2B illustrating a perspective view with a top cover removed, and FIG. 3C illustrating a side view. Single inlet viscous blower fan 60 includes a housing 62 enclosing impeller 30, with housing 62 including a top cover 64 and a bottom cover 66 which together form a flow tunnel 70 (or duct) about a portion of the outer circumferences of first and second wave blades 38 and 40. In one example, flow tunnel 70 increases in area from an inlet throat 72 to an outlet region 74. Top cover 64 defines an upper air inlet 76 disposed over impeller 30, and top and bottom covers 64 and 66 together forming an output air vent 78 of housing 62. In examples, upper air inlet 76 is a circular air inlet having a diameter d4 which is greater than hub diameter d1, but less than outer diameter, d2, of first and second wave blades 38 and 40. In one example, air inlet diameter d4 is the same as diameter d3.

In operation, which will be described in greater detail below (see FIG. 3), when impeller 30 is rotated about rotational axis 34 (as illustrated by the rotational arrow in FIG. 2A), a shear force between first and second wave blades 38 and 40 creates a viscous air flow which draws intake air 80 through upper air inlet 76. A centrifugal force of impeller 30 accelerates the viscous air flow across the surfaces of first and second wave blades 38 and 40 into flow tunnel to form an output air flow 82 at output air vent 78. It is noted that in a dual-inlet blower fan design, bottom cover 66 also includes an air inlet (a lower air inlet) which is disposed opposite upper air inlet 76 of top cover 64 so that a dual inlet impeller (e.g., see FIGS. 4A-6) draws intake air through both the upper and lower air inlets.

Figure 3:
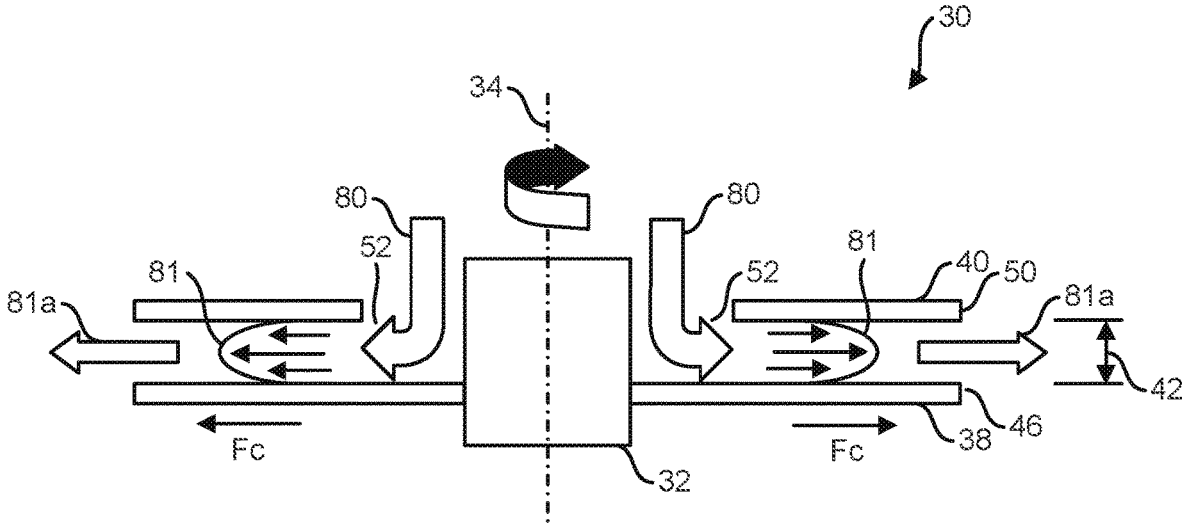
FIG. 3 is a simplified cross-sectional view generally illustrating operation of an impeller in a single inlet implementation, according to one example.

FIG. 3 generally illustrates a simplified cross-sectional view of impeller 30 and schematically illustrates an operation of impeller 30 to create a viscous air flow for a single inlet fan configuration. When driven about rotational axis 34 (as indicated by the rotational arrow in FIG. 3), a shear force is created in blade gap 42 between opposing major surfaces of first and second wave blades 38 and 40. Due to a viscosity of the air, the shear force together with a centrifugal force, Fc, created by rotation of impeller 30, generates a viscous air flow 81 which between first and second blades 38 which moves toward outer perimeters 46 and 50 and draws an intake air flow 80 through air intake gap 52. The centrifugal force, Fc, accelerates viscous air 81 to generate an accelerated viscous air flow 81*a* which is forced into flow tunnel 70 to form output air flow 82 (see FIG. 2A).

FIGS. 4A-4D respectively illustrate a perspective view, a top view, a side view, and a simplified cross-sectional view of a viscous flow impeller 30-1, in accordance with the present disclosure, implemented for use with a dual inlet viscous blower fan (e.g., a fan having upper and lower air inlets). Impeller 30-1 is similar to impeller 30 described above, except that both first and second wave blades 38 and 40 are spaced from perimeter 36 of hub 32, such that first and second wave blades 38 and 40 each form an air intake gap 52 between an inner circumference outer perimeter 36 of hub 32. In one example, as illustrated, first and second wave blades 38 and 40 each have an inner diameter, d5, and an outer diameter, d6.

Figure 4A:
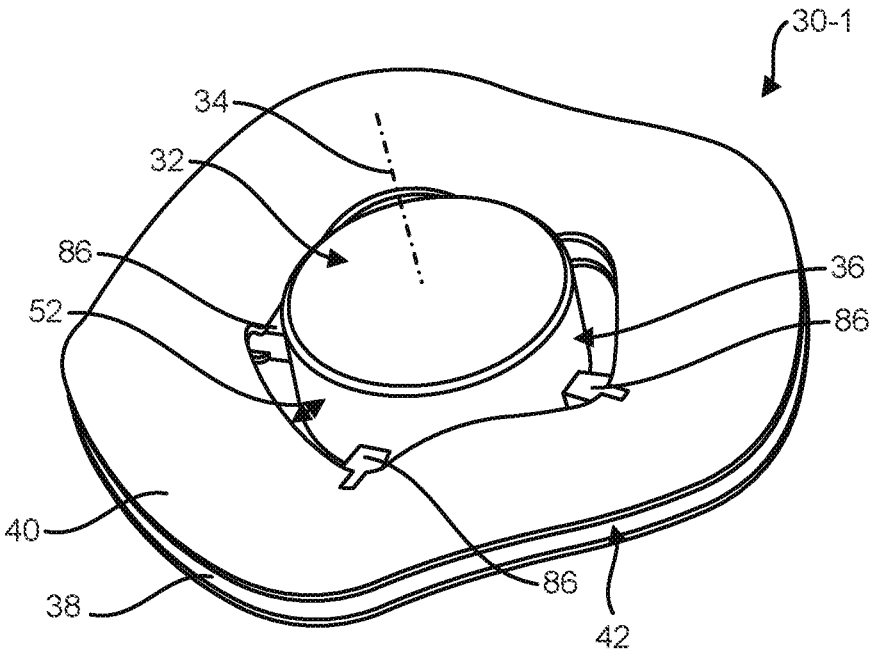
FIG. 4A a perspective view of a viscous flow impeller for a viscous flow blower fan, according to one example.
Figure 4B:
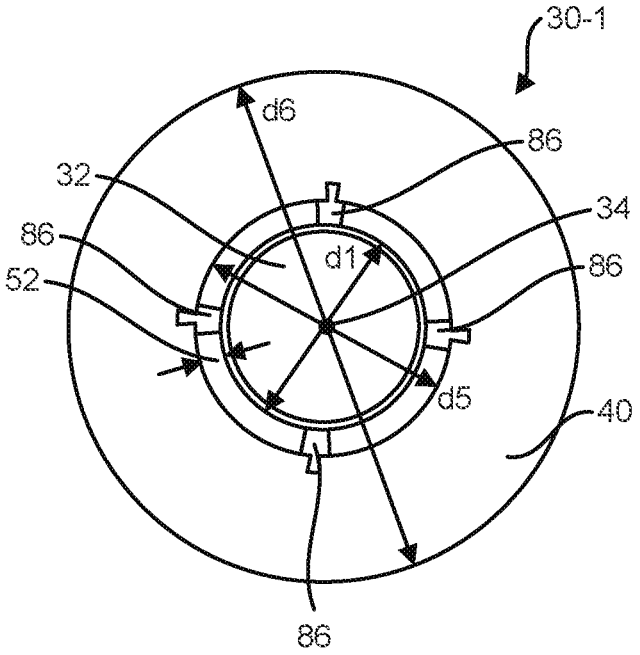
FIG. 4B is a top view of a viscous flow impeller for a viscous flow blower fan, according to one example.
Figure 4C:
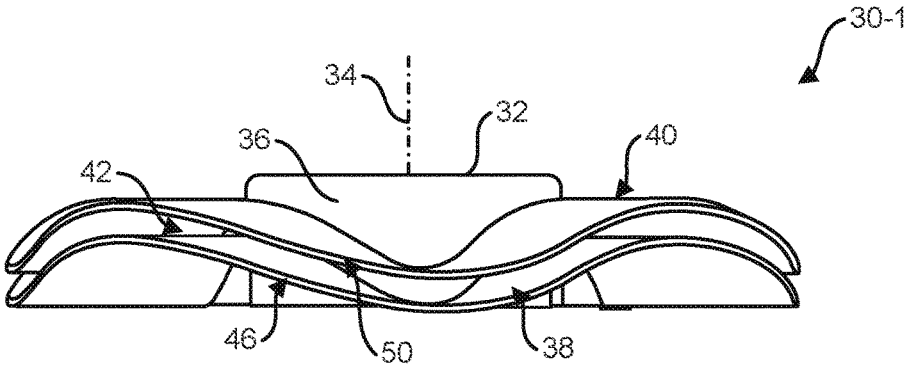
FIG. 4C, a side view of a viscous flow impeller for a viscous flow blower fan, according to one example.
Figure 4D:
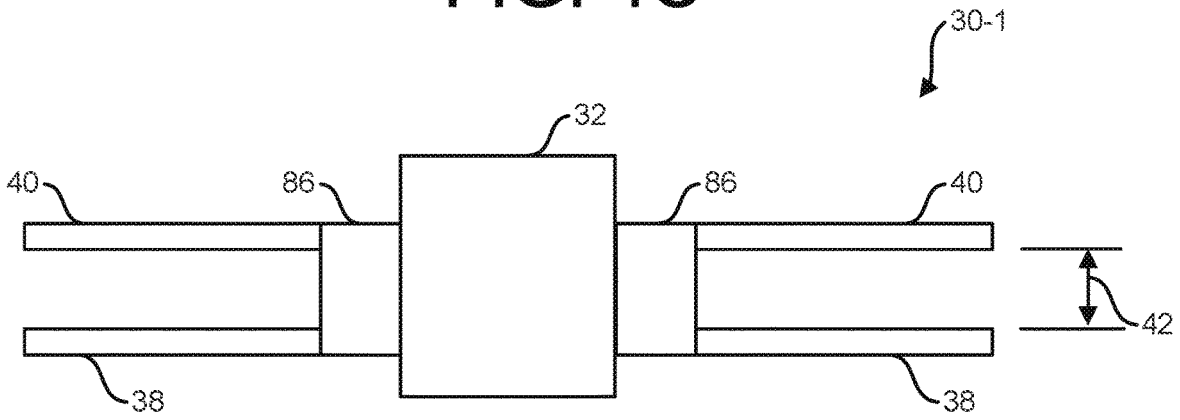
FIG. 4D is a simplified cross-sectional view of a viscous flow impeller, according to one example.

Additionally, with particular reference to FIG. 4D, rather than second wave blade 40 being mounted to first wave blade 38 (such as by support posts 41), according to one example, first and second wave blades 38 and 40 are mounted to and extend from outer perimeter 36 of hub 32 by a plurality of standoff elements 86 disposed about a circumference of hub 32. In one example, standoff elements 86 space an inner circumference of wave first and second blades 38 and 40 from outer perimeter of hub 32 to define a width of air intake gap 52 and vertically offset opposing major surfaces of first and second wave blades 38 and 40 from one another to define a width of blade gap 42.

Figure 5:
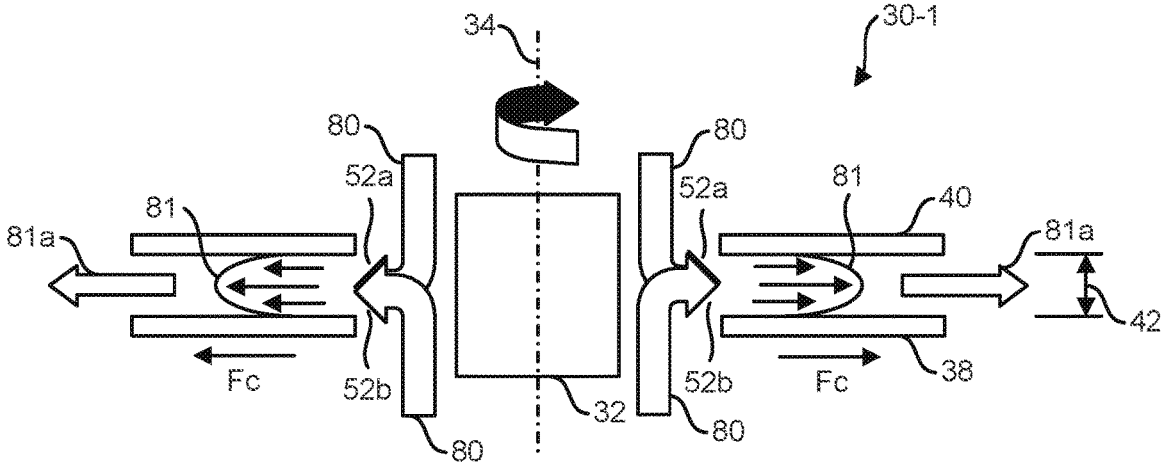
FIG. 5 is a simplified cross-sectional view generally illustrating operation of an impeller in a dual inlet implementation, according to one example.

FIG. 5 generally illustrates a simplified cross-sectional view of impeller 30-1 and schematically illustrates an operation of impeller 30-1 to create a viscous air flow for a dual inlet fan configuration. The operation of impeller 30-1 is similar to that of impeller 30 (as illustrated by FIG. 3), except that intake air flows 80 into blade gap 42 between first and second wave blades 38 and 40 are drawn through an upper air intake gap 52*a* and a lower air intake gap 52*b*.

Figure 6A:
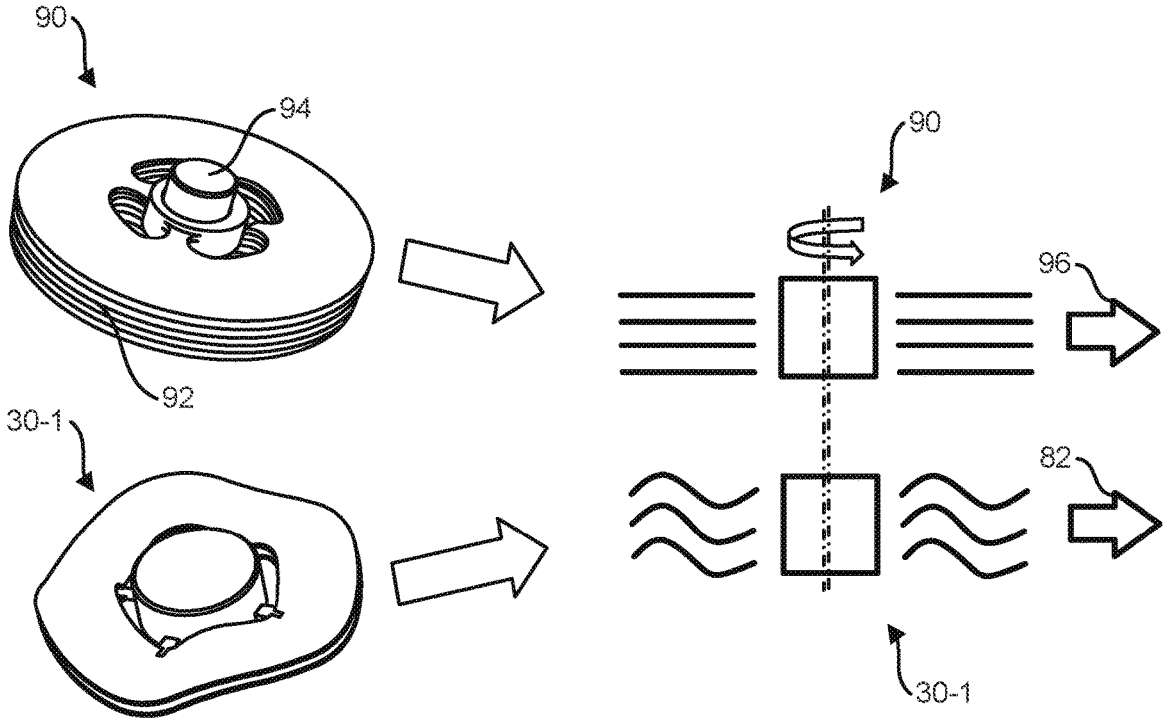
FIG. 6A is a simplified schematic diagram generally illustrating comparisons of performance between a conventional impeller and an impeller, employing wave blades, in accordance with the present disclosure.
Figure 6B:
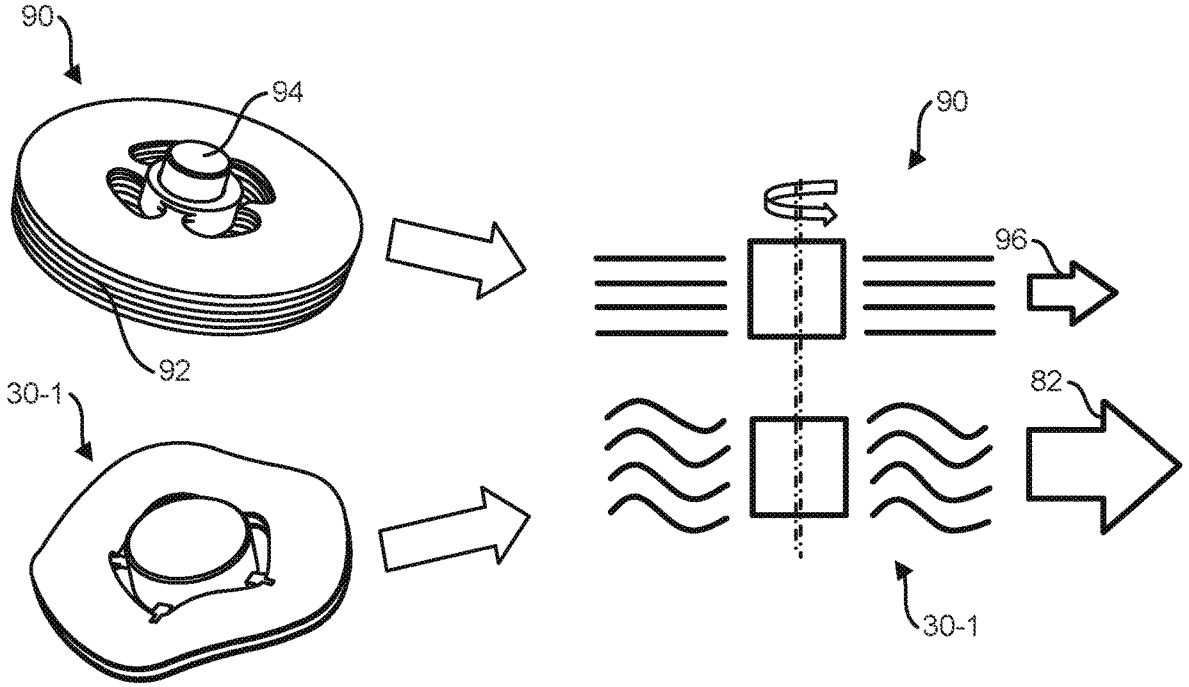
FIG. 6B is a simplified schematic diagram generally illustrating comparisons of performance between a conventional impeller and an impeller, employing wave blades, in accordance with the present disclosure.

FIGS. 6A and 6B are simplified schematic diagrams generally illustrating comparisons of performance between a conventional viscous flow impeller 90 employing a stack of conventional flat disk blades 92 coupled to a hub 94, and an impeller, such as impeller 30-1, employing a number of wave blades, such as first and second wave blades 38 and 40, in accordance with the present disclosure. Although described above primarily as employing a stack of two wave blades, such as first and second wave blades 38 and 40, impellers, in accordance with the present disclosure, may be employ any suitable number of wave blades (such as 3, 4, or 5 wave blades), so long as at least two wave blades are used.

FIG. 6A graphically illustrates that, due to the increased surface area between opposing surfaces of wave blades, in accordance with the present disclosure, an impeller in accordance with the present disclosure, such as impeller 30-1, is able to generate at least a same output air flow 82 as an output air flow 96 of a conventional viscous flow impeller 90 having a greater number of flat disk blades 92. For example, as illustrated, an impeller 30-1 employing a set of three wave blades may generate at least a same air flow as conventional viscous flow impeller 90 employing a set of four conventional flat disk blades 92.

FIG. 6B graphically illustrates that an impeller in accordance with the present disclosure, such as impeller 30-1, is able to generate a greater output air flow 82 than output air flow 96 of conventional viscous flow impeller 90 employing a same number of flat disk blades 92. For example, as illustrated, an impeller 30-1 employing a set of four wave blades generates a greater air flow relative to conventional viscous flow impeller 90 employing a set of four conventional flat disk blades 92.

Similarly, depending on space limitations, an impeller employing wave blades, in accordance with the present disclosure, such as impeller 30-1 employing first and second wave blades 38 and 40, is able to generate a greater output air flow in a same amount of physical space as a conventional viscous blow employing conventional flat disk blades (or a same amount of air flow in less physical space as compared to a conventional viscous blower). As a result, for generating a given air flow, a viscous blower fan employing wave blades, in accordance with the present disclosure, may require fewer parts and, thus, require fewer tooling parts for manufacture and assembly, thereby reducing costs.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. An impeller for a viscous flow fan comprising:
a hub having a longitudinal axis;
a plurality of ring-shaped wave blades disposed about and coupled to a perimeter of the hub, the wave blades disposed in parallel and spaced apart from one another along the longitudinal axis by a blade gap, each wave blade having:
a center coincident with the longitudinal axis;
an inner perimeter;
an outer perimeter; and
a wave-like cross-section about the perimeter of the hub in a direction perpendicular to the longitudinal axis, wherein at least a portion of the inner perimeter of at least one of the wave blades is spaced from the perimeter of the hub to form an air intake gap.

2. The impeller of claim 1, wherein opposing major surfaces of adjacent wave blades are in parallel with one another and separated by the blade gap.

3. The impeller of claim 1, wherein the hub comprises a cylinder, the hub having a hub diameter.

4. The impeller of claim 3, the plurality of wave blades including a first wave blade and a second wave blade, wherein the first and second wave blades are circular with each having an outer perimeter comprising a same outer diameter, wherein the first wave blade has an inner perimeter comprising an inner diameter equal to the hub diameter and is coupled to the hub, wherein the second blade has an inner perimeter comprising an inner diameter greater than the hub diameter so as to form the intake gap between the inner diameter and hub perimeter.

5. The impeller of claim 4, wherein the second blade is coupled to the first blade.

6. The impeller of claim 5, wherein a plurality of support posts are disposed about a same diameter of the first and second blades, wherein the support posts couple opposing major surfaces of the first and second blades to one another and maintain the blade gap there between.

7. The impeller of claim 3, wherein the plurality of wave blades includes a first wave blade and a second wave blade each connected to the hub, wherein the first and second wave blades are circular with each having an outer perimeter comprising a same outer diameter and an inner perimeter comprising a same inner diameter, wherein the inner diameter is greater than the hub diameter so as to form an air intake gap between the inner diameter and the hub perimeter.

8. The impeller of claim 7, further including a plurality of standoff elements disposed about the perimeter of the hub and which couple the inner diameter of the first and second wave blades to the hub, wherein the standoff elements space the in diameter of the first and second wave blades from the perimeter of hub to define a width of the air intake gap and vertically offset opposing major surfaces of the first and second wave blades from one another to define a width of the blade gap.

9. The impeller of claim 1, wherein the blade gap is not greater than 5 millimeters.

10. The impeller of claim 1, wherein the wave-like cross-section is sinusoidal.

11. A viscous flow fan comprising:

an impeller including:

a cylindrical hub having a longitudinal axis; and a plurality of ring-shaped wave blades disposed about and coupled to a perimeter of the hub, the wave blades disposed in a parallel and spaced apart from one another along the longitudinal axis by a blade gap, each wave blade having:

a center coincident with the longitudinal axis;

an inner diameter;

an outer diameter; and a wave-like cross-section about the perimeter of the hub in a direction perpendicular to the longitudinal axis, wherein at least a portion of the inner diameter of at least one of the wave blades is spaced from the perimeter of the hub to form an air intake gap; and a housing enclosing the impeller, the housing including:

a flow tunnel about at least a portion of the outer diameter of the wave blades;

at least one air intake disposed in parallel with a major surface the of the wave blade forming the intake air gap; and an output air vent in fluidic communication with the flow tunnel.

12. The viscous flow fan of claim 11, the plurality of wave blades including a first wave blade and a second wave blade, wherein the first and second wave blades have a same outer diameter, wherein the first wave blade has an inner perimeter comprising an inner diameter equal to the hub diameter and is coupled to the hub, wherein the second blade has an inner perimeter comprising an inner diameter greater than the hub diameter so as to form the at least one intake gap between the inner diameter and hub perimeter.

13. The viscous flow fan of claim 11, wherein the plurality of wave blades includes a first wave blade and a second wave blade each connected to the hub, wherein the first and second wave blades have a same outer diameter and a same inner diameter, wherein the inner diameter is greater than the hub diameter so as to form an air intake gap between the inner diameter and the hub perimeter of each of the first and second wave blades, and wherein the housing includes a first air intake on one side of the housing proximate to the first wave blade and a second air intake on an opposite side of the housing proximate to the second wave blade.

14. An impeller for a viscous flow fan comprising:

a cylindrical hub having a hub diameter and a longitudinal axis defining an axis of rotation; and a plurality of ring-shaped circular disk blades disposed about a perimeter of the hub, the disk blades disposed in a parallel and spaced apart from one another along the longitudinal axis by a blade gap, each disk blade having:

a center coincident with the longitudinal axis;

an outer diameter;

an inner diameter greater than the hub diameter so as to be spaced from a perimeter of the hub to form an air intake gap; and a wave-like cross-section about the perimeter of the hub in a direction perpendicular to the longitudinal axis.

15. The impeller of claim 14, wherein opposing major surfaces of adjacent disk blades are in parallel and spaced from one another by the blade gap.

* * * * *